US011116342B1

(12) United States Patent
Braziel

(10) Patent No.: US 11,116,342 B1
(45) Date of Patent: Sep. 14, 2021

(54) POCKET STRAW

(71) Applicant: William Braziel, Whitwell, TN (US)

(72) Inventor: William Braziel, Whitwell, TN (US)

( * ) Notice: Subject to any disclaimer, the term of this patent is extended or adjusted under 35 U.S.C. 154(b) by 76 days.

(21) Appl. No.: 16/708,771

(22) Filed: Dec. 10, 2019

(51) Int. Cl.
*A47G 21/18* (2006.01)

(52) U.S. Cl.
CPC ..... *A47G 21/189* (2013.01); *A47G 21/18* (2013.01)

(58) Field of Classification Search
CPC ..... A47G 21/18; A47G 21/189
USPC ..... 239/33; 285/302
See application file for complete search history.

(56) References Cited

U.S. PATENT DOCUMENTS

| | | | | |
|---|---|---|---|---|
| 1,236,029 | A | 8/1917 | Williams | |
| 2,192,036 | A | 2/1940 | Hamilton | |
| 4,688,721 | A | 8/1987 | Inaba | |
| 4,736,887 | A | 4/1988 | Inaba | |
| 4,850,533 | A | 7/1989 | Hoshi | |
| 7,997,509 | B2 * | 8/2011 | Karklins | B65D 83/0005 239/33 |
| D798,095 | S | 9/2017 | Palazzi | |
| D847,568 | S | 5/2019 | Hartnett | |
| 2011/0233297 | A1 | 9/2011 | Roche | |
| 2012/0160928 | A1 * | 6/2012 | Jo | A47G 21/183 239/33 |
| 2014/0231535 | A1 | 8/2014 | Alotaibi | |
| 2020/0008599 | A1 * | 1/2020 | Price | A47G 21/189 |
| 2021/0045558 | A1 * | 2/2021 | Aveles, Jr. | A47G 21/189 |

* cited by examiner

*Primary Examiner* — Steven J Ganey
(74) *Attorney, Agent, or Firm* — Kyle A. Fletcher, Esq.

(57) ABSTRACT

The pocket straw is a straw. The straw is a tube used to consume a liquid. The pocket straw comprises a tubular transport structure and a plurality of caps. The tubular transport structure has a composite prism structure. The tubular transport structure has a tube structure. The tubular transport structure forms the tube of the pocket straw. A vacuum is created at an end of the tubular transport structure such that the liquid is drawn through the tubular transport structure for consumption. The tubular transport structure is a telescopic structure such that the span of the length of the center axis of the tubular transport structure is adjustable. The plurality of caps enclose the open ends of the tube structure of the tubular transport structure when the pocket straw is not in use.

17 Claims, 5 Drawing Sheets

POCKET STRAW

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of domestic articles including table equipment, more specifically, a drinking straw. (A47G21/18)

SUMMARY OF INVENTION

The pocket straw is a straw. The straw is a tube used to consume a liquid. The pocket straw comprises a tubular transport structure and a plurality of caps. The tubular transport structure has a composite prism structure. The tubular transport structure has a tube structure. The tubular transport structure forms the tube of the pocket straw. A vacuum is created at an end of the tubular transport structure such that the liquid is drawn through the tubular transport structure for consumption. The tubular transport structure is a telescopic structure such that the span of the length of the center axis of the tubular transport structure is adjustable. The plurality of caps enclose the open ends of the tube structure of the tubular transport structure when the pocket straw is not in use.

These together with additional objects, features and advantages of the pocket straw will be readily apparent to those of ordinary skill in the art upon reading the following detailed description of the presently preferred, but nonetheless illustrative, embodiments when taken in conjunction with the accompanying drawings.

In this respect, before explaining the current embodiments of the pocket straw in detail, it is to be understood that the pocket straw is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the pocket straw.

It is therefore important that the claims be regarded as including such equivalent construction insofar as they do not depart from the spirit and scope of the pocket straw. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
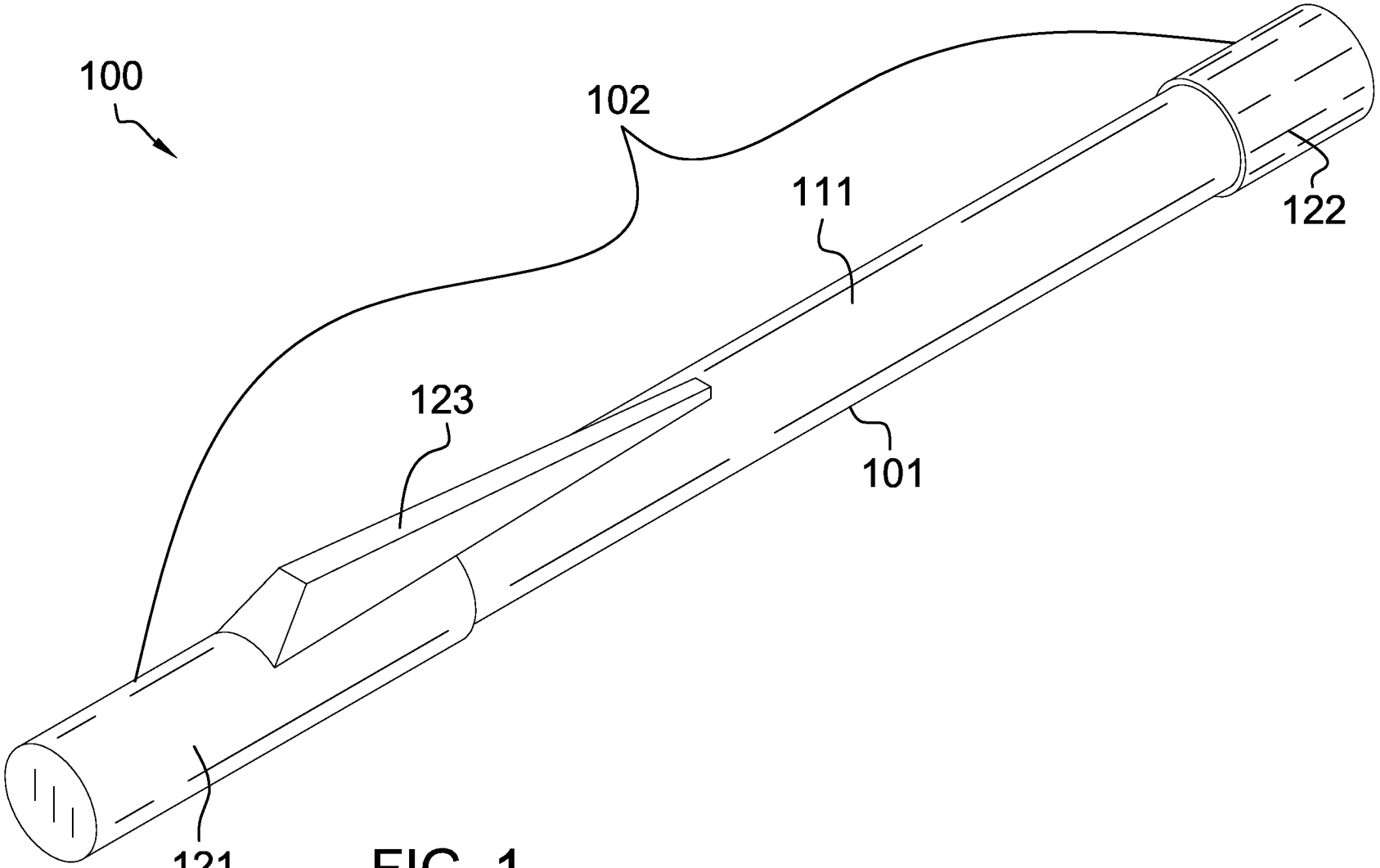
FIG. 1 is a perspective view of an embodiment of the disclosure.
Figure 2:
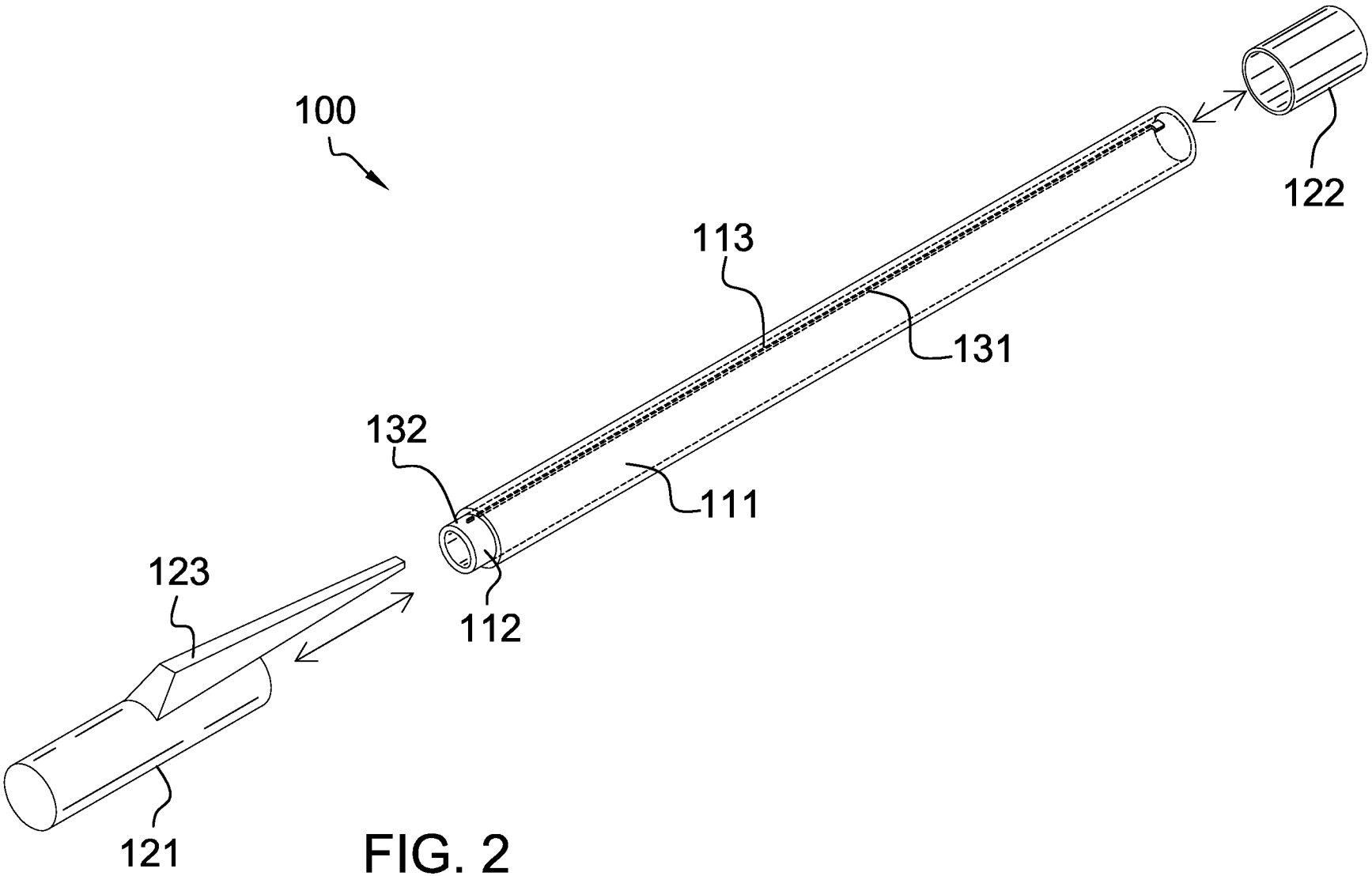
FIG. 2 is a detail view of an embodiment of the disclosure.
Figure 3:
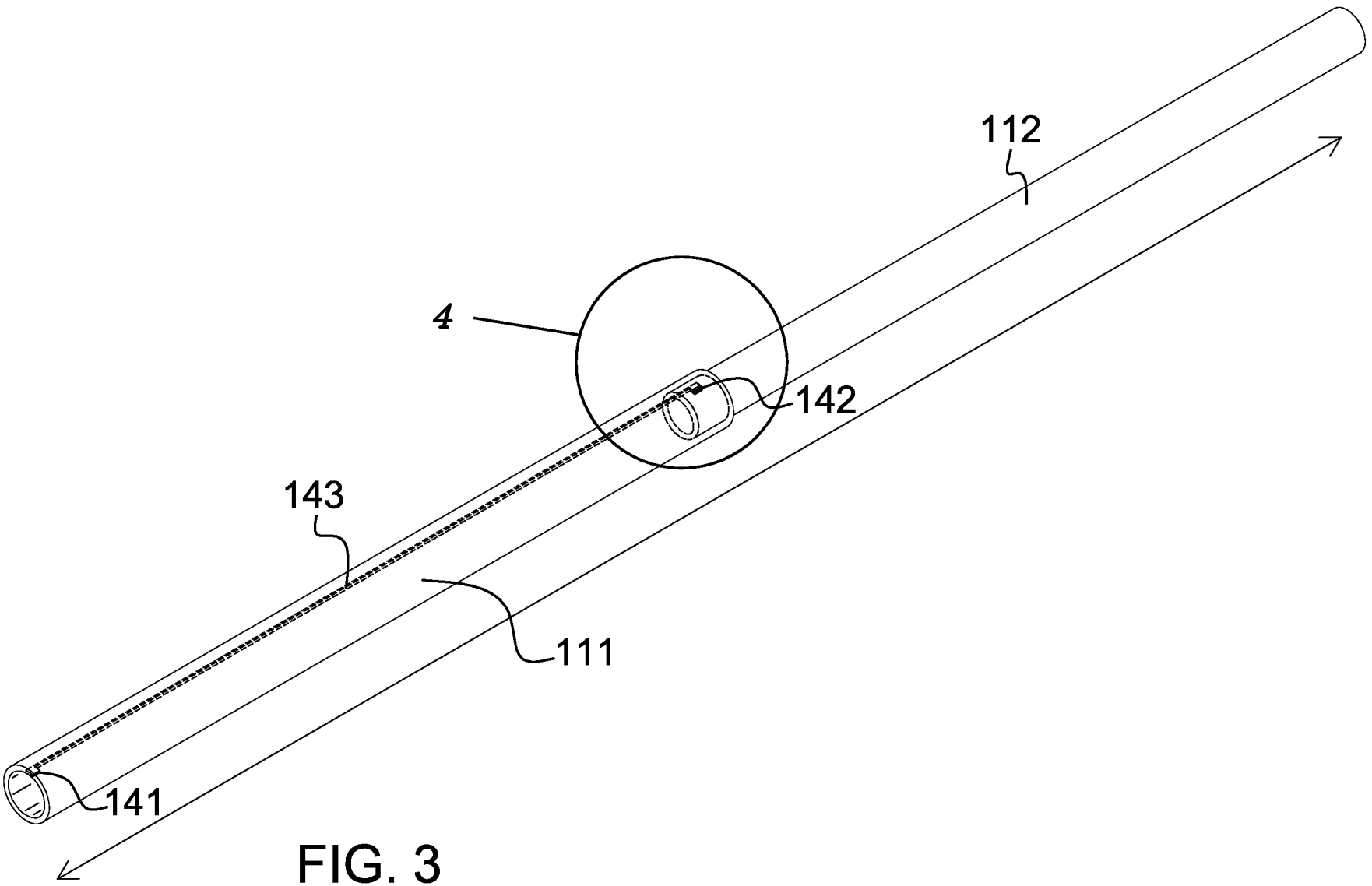
FIG. 3 is an in-use view of an embodiment of the disclosure.
Figure 4:
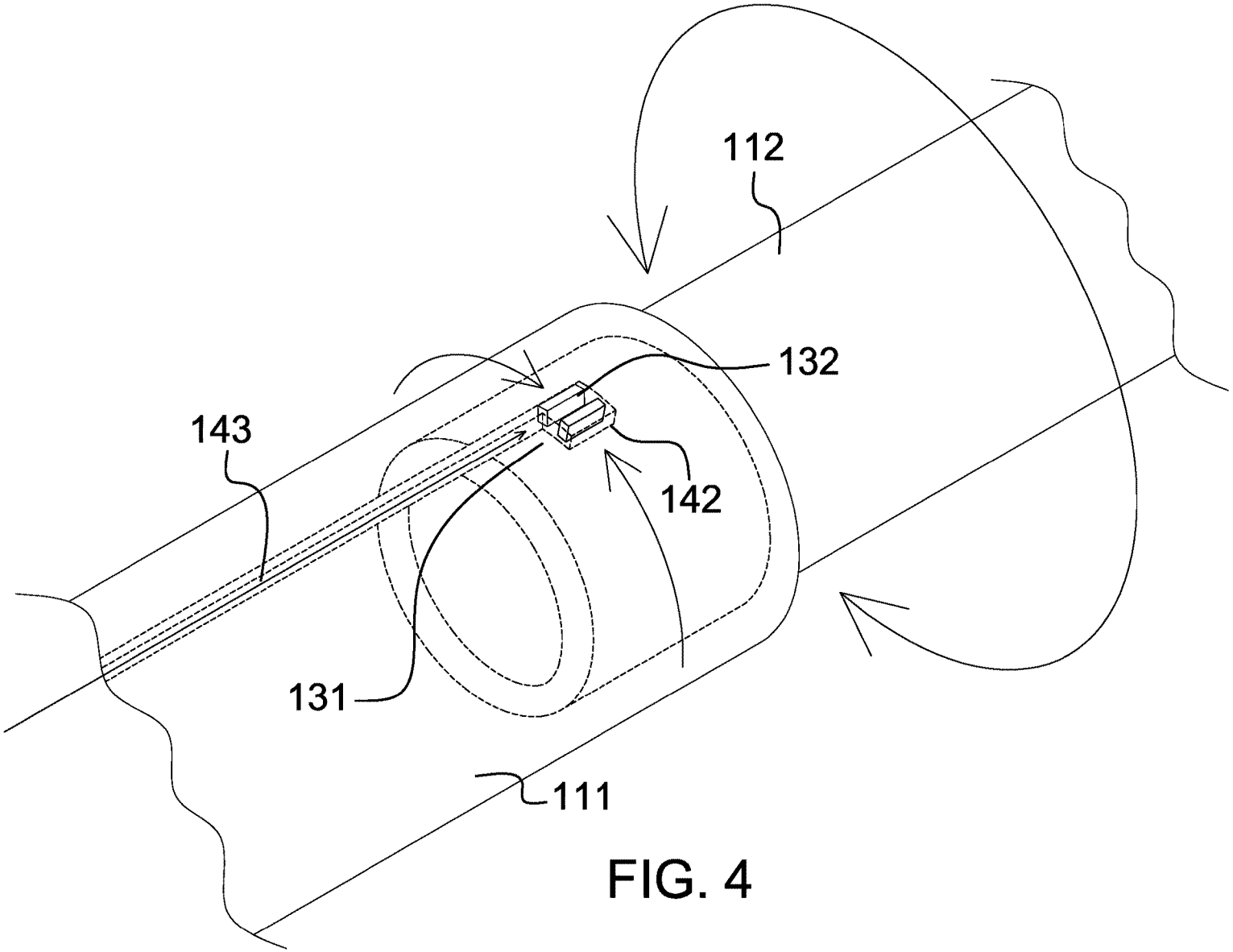
FIG. 4 is a detail view of an embodiment of the disclosure.
Figure 5:
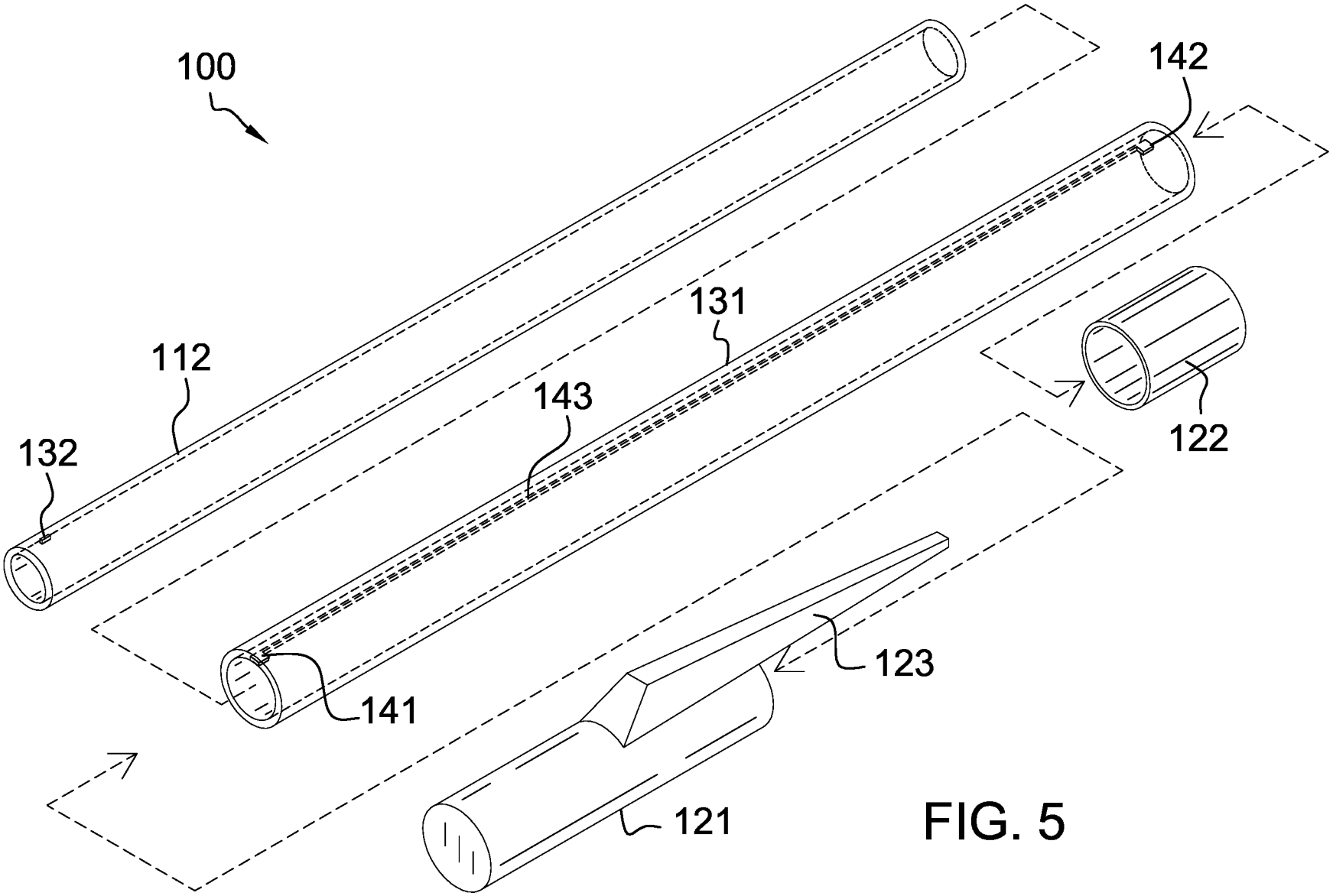
FIG. 5 is an exploded view of an embodiment of the disclosure.

Detailed reference will now be made to one or more potential embodiments of the disclosure, which are illustrated in FIGS. 1 through 5.

The pocket straw 100 (hereinafter invention) is a straw. The straw is a tube used to consume a liquid. The invention 100 comprises a tubular transport structure 101 and a plurality of caps 102. The tubular transport structure 101 has a composite prism structure. The tubular transport structure 101 has a tube structure. The tubular transport structure 101 forms the tube of the invention 100. A vacuum is created at an end of the tubular transport structure 101 such that the liquid is drawn through the tubular transport structure 101 for consumption. The tubular transport structure 101 is a telescopic structure such that the span of the length of the center axis of the tubular transport structure 101 is adjustable. The plurality of caps 102 enclose the open ends of the tube structure of the tubular transport structure 101 when the invention 100 is not in use.

The tubular transport structure 101 is the structure of the invention 100 that transports a liquid. The tubular transport structure 101 is a composite prism structure. The tubular transport structure 101 is a tube-shaped structure. The tubular transport structure 101 is a telescopic structure such that the span of the length of the composite prism structure of the tubular transport structure 101 is adjustable.

The tubular transport structure 101 is a telescopic structure that comprises a first arm 111, a second arm 112, and a detent 113. The detent 113 is a mechanical device that locks and secures the first arm 111 to the second arm 112. The first arm 111 is a hollow tubular prism that is further defined with a first inner dimension and a first outer dimension. The second arm 112 is a hollow tubular prism that is further defined with a second inner dimension and a second outer dimension. The second arm 112 is geometrically similar to the first arm 111. The span of the second outer dimension of the second arm 112 is lesser than the span of the first inner dimension of the first arm 111 such that the second arm 112 inserts into the first arm 111 in a telescopic fashion to form a composite prism structure.

The span of the length of the tubular transport structure 101 adjusts by adjusting the relative position of the second arm 112 within the first arm 111. The position of the second arm 112 relative to the first arm 111 is held in position using the detent 113. The detent 113 is selected from the group consisting of a cotter pin, a G snap collar, a cam lock collar, a threaded clutch, a split collar lock, and a spring-loaded ball lock.

The detent 113 comprises a first arm 111 slot 131 and a second arm 112 nib 132.

The second arm 112 nib 132 is a rectangular block structure that attaches to the exterior surface of the lateral face of the second arm 112. The second arm 112 nib 132 is sized such that the second arm 112 nib 132 fits into the negative space formed by the first arm 111 slot 131. The first arm 111 slot 131 guides the motion of the second arm 112 nib 132 as the position of the second arm 112 within the first arm 111 changes.

The first arm 111 slot 131 is a negative space that is formed in the interior surface of the lateral face of the first arm 111. The first arm 111 slot 131 has a roughly prism-shaped structure. The first arm 111 slot 131 forms a track that guides the motion of the second arm 112 through the first arm 111. The first arm 111 slot 131 further comprises a first anchor notch 141, a second anchor notch 142, and a groove 143.

The groove 143 is a negative space that is formed in the interior surface of the lateral face of the first arm 111. The groove 143 has a roughly prism-shaped structure. The center axis of the rough prism shape of the groove 143 is parallel to the center axis of the first arm 111. The groove 143 is sized to receive the second arm 112 nib 132. The groove 143 forms a track that guides the motion of the second arm 112 nib 132 as the second arm 112 moves in the first arm 111 in a direction parallel to the center axis of the first arm 111.

The first anchor notch 141 is a negative space that is formed in the interior surface of the lateral face of the first arm 111. The negative space that forms the first anchor notch 141 forms an extension of the negative space formed by the groove 143. The first anchor notch 141 attaches to the lateral face of the negative space of the groove 143 at a position proximal to a congruent end of the roughly prism-shaped structure of the groove 143. The first anchor notch 141 is sized to receive the second arm 112 nib 132. The first anchor notch 141 forms a track that guides the motion of the second arm 112 nib 132 as the second arm 112 rotates within the first arm 111 around an axis of rotation aligned with the center axis of the first arm 111. The first anchor notch 141 locks the second arm 112 into a fixed position relative to the first arm 111 when the second arm 112 nib 132 rotates into the first anchor notch 141.

The second anchor notch 142 is a negative space that is formed in the interior surface of the lateral face of the first arm 111. The negative space that forms the second anchor notch 142 forms an extension of the negative space formed by the groove 143. The second anchor notch 142 attaches to the lateral face of the negative space of the groove 143 at a position proximal to the congruent end of the roughly prism-shaped structure of the groove 143 that is distal from the first anchor notch 141. The second anchor notch 142 is sized to receive the second arm 112 nib 132. The second anchor notch 142 forms a track that guides the motion of the second arm 112 nib 132 as the second arm 112 rotates within the first arm 111 around an axis of rotation aligned with the center axis of the first arm 111. The second anchor notch 142 locks the second arm 112 into a fixed position relative to the first arm 111 when the second arm 112 nib 132 rotates into the second anchor notch 142.

Each of the plurality of caps 102 is a lid that encloses an open end of the tubular structure of the tubular transport structure 101. Each of the plurality of caps 102 fits over the outer dimension of the tubular structure of the tubular transport structure 101. The plurality of caps 102 comprises a first capped tube 121 and a second capped tube 122.

The first capped tube 121 is a lid that encloses the open end of the second arm 112 of the tubular transport structure 101 that is distal from the first arm 111. The first capped tube 121 is a prism structure. The first capped tube 121 has a capped tube shape. The first capped tube 121 is further defined with a third inner diameter. The span of the length of the third inner diameter of the first capped tube 121 is greater than the span of the length of the second outer diameter of the second arm 112 such that the first capped tube 121 fits over and encloses the second arm 112 during storage. The first capped tube 121 further comprises a pocket clip 123.

The pocket clip 123 is a roughly prism-shaped structure. The pocket clip 123 attaches to the exterior surface of the first capped tube 121 such that the center axis of the pocket clip 123 is parallel to the center axis of the first capped tube 121. The pocket clip 123 attaches to the first capped tube 121 in the manner of a cantilever. The pocket clip 123 attaches to the first capped tube 121 such that the free end of the cantilever structure of the pocket clip 123 extends beyond the open end of the capped tube structure of the first capped tube 121. The pocket clip 123 attaches the invention 100 to a sheeting such as the textile used to form a pocket in clothing.

The pocket clip 123 acts as a spring. Specifically, when a force is applied perpendicularly to the center axis of the prism structure of a pocket clip 123, the elasticity of the pocket clip 123 creates a rotational torque that opposes the displacement created by rotating the pocket clip 123 around a pivot point located at the end where the pocket clip 123 is attached to the first capped tube 121. This rotational torque places a strain on the pocket clip 123 such that the force of the strain is in the direction that returns the pocket clip 123 to its original position. When a sheeting is inserted between the pocket clip 123 and tubular transport structure 101, this spring-like action produces a clamping force that holds the invention 100 securely in position against the sheeting.

The second capped tube 122 is a lid that encloses the open end of the first arm 111 of the tubular transport structure 101 that is distal from the second arm 112. The second capped tube 122 is a prism structure. The second capped tube 122 has a capped tube shape. The second capped tube 122 is further defined with a fourth inner diameter. The span of the length of the fourth inner diameter of the second capped tube 122 is greater than the span of the length of the first outer diameter of the first arm 111 such that the second capped tube 122 fits over and encloses the first arm 111 during storage.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Cantilever: As used in this disclosure, a cantilever is a beam or other structure that projects away from an object and is supported on only one end. A cantilever is further defined with a fixed end and a free end. The fixed end is the end of the cantilever that is attached to the object. The free end is the end of the cantilever that is distal from the fixed end.

Cap: As used in this disclosure, a cap is a protective cover that encloses a space or opening.

Capped Tube: As used in this disclosure, a capped tube is a tube with one closed end and one open end.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Clip: As used in this disclosure, a clip is a fastener that attaches to an object by gripping or clasping the object. A clip is typically spring loaded.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar. Use Prism, pyramid, geometrically similar, truncated, align Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Detent: As used in this disclosure, a detent is a device for positioning and holding a first object relative to a second object such that the position of the first object relative to the second object is adjustable.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Extensible: As used in this disclosure, extensible is an adjective that describes an object made of sections that fit or together such that the object can be made longer or shorter by adjusting the relative positions of the sections.

Exterior: As used in this disclosure, the exterior is used as a relational term that implies that an object is not contained within the boundary of a structure or a space.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Groove: As used in this disclosure, a groove is a negative space that forms a channel or trough used to guide the motion of an object.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interior: As used in this disclosure, the interior is used as a relational term that implies that an object is contained within the boundary of a structure or a space.

Lid: As used in this disclosure, a lid is a removable cover that is placed over an opening of a hollow structure to enclose the hollow structure.

Liquid: As used in this disclosure, a liquid refers to a state (phase) of matter that is fluid and that maintains, for a given pressure, a fixed volume that is independent of the volume of the container.

Negative Space: As used in this disclosure, negative space is a method of defining an object through the use of open or empty space as the definition of the object itself, or, through the use of open or empty space to describe the boundaries of an object.

Not Significantly Different: As used in this disclosure, the term not significantly different compares a specified property of a first object to the corresponding property of a reference object (reference property). The specified property is considered to be not significantly different from the reference property when the absolute value of the difference between the specified property and the reference property is less than 10.0% of the reference property value. A negligible difference is considered to be not significantly different.

Notch: As used in this disclosure, a notch is: 1) an indentation formed in an edge; or 2) a cavity or aperture formed within a surface.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Perimeter: As used in this disclosure, a perimeter is one or more curved or straight lines that bounds an enclosed area on a plane or surface. The perimeter of a circle is commonly referred to as a circumference.

Phase: As used in this disclosure, phase refers to the state of the form of matter. The common states of matter are solid, liquid, gas, and plasma.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rectangular Block: As used in this disclosure, a rectangular block refers to a three-dimensional prism structure comprising six rectangular surfaces (commonly called faces) formed at right angles. Within this disclosure, a rectangular block may further comprise rounded edges and corners.

Rigid Structure: As used in this disclosure, a rigid structure is a solid structure formed from an inelastic material that resists changes in shape. A rigid structure will permanently deform as it fails under a force.

Rotation: As used in this disclosure, rotation refers to the cyclic movement of an object around a fixed point or fixed axis. The verb of rotation is to rotate.

Roughly: As used in this disclosure, roughly refers to a comparison between two objects. Roughly means that the difference between one or more parameters of the two compared objects are not significantly different.

Rounded: A used in this disclosure, the term rounded refers to the replacement of an apex, vertex, or edge or brink of a structure with a (generally smooth) curvature wherein the concave portion of the curvature faces the interior or center of the structure.

Rounded Rectangle: A used in this disclosure, a rounded rectangle is a rectangle wherein one or more of the corner structures of the rectangle are replaced with a curvature wherein the concave portion of the curvature faces the center of the rounded rectangle.

Semi-Rigid Structure: As used in this disclosure, a semi-rigid structure is a solid structure that is stiff but not wholly inflexible and that will deform under force before breaking. A semi-rigid structure may or may not behave with an elastic nature in that a semi-rigid structure need not return to its relaxed shape.

Slot: As used in this disclosure, a slot is a prism-shaped groove or aperture that is formed in an object.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Suction: As used in this disclosure, suction refers to the generation of a vacuum that is used to transport a fluid.

Telescopic: As used in this disclosure, telescopic is an adjective that describes an object made of sections that fit or slide into each other such that the object can be made longer or shorter by adjusting the relative positions of the sections.

Tube: As used in this disclosure, a tube is a hollow prism-shaped device formed with two open ends. The tube is used for transporting liquids and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Vacuum: As used in this disclosure, vacuum is used to describe a first space that contains gas at a reduced gas pressure relative to the gas pressure of a second space. If the first space and the second space are connected together, this pressure differential will cause gas from the second space to move towards the first space until the pressure differential is eliminated.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A beverage straw comprising a tubular transport structure and a plurality of caps;

wherein the tubular transport structure has a tube structure having open ends;

wherein the plurality of caps enclose the open ends of the tube structure of the tubular transport structure;

wherein the tubular transport structure has a composite prism structure;

wherein the tubular transport structure forms a tube of the beverage straw;

wherein the tubular transport structure is a telescopic structure such that a span of a length of a center axis of the tubular transport structure is adjustable;

wherein the tubular transport structure comprises a first arm, a second arm, and a detent;

wherein the detent is a mechanical device that locks and secures the first arm to the second arm.

2. The beverage straw according to claim 1 wherein the first arm is a hollow tubular prism that is further defined with a first inner dimension and a first outer dimension;

wherein the second arm is a hollow tubular prism that is further defined with a second inner dimension and a second outer dimension.

3. The beverage straw according to claim 2 wherein the second arm is geometrically similar to the first arm.

4. The beverage straw according to claim 3 wherein the span of the second outer dimension of the second arm is lesser than the span of the first inner dimension of the first arm such that the second arm inserts into the first arm in a telescopic fashion to form a composite prism structure;

wherein the span of the length of the tubular transport structure adjusts by adjusting the relative position of the second arm within the first arm.

5. The beverage straw according to claim 4 wherein the position of the second arm relative to the first arm is held in position using the detent.

6. The beverage straw according to claim 5 wherein the detent comprises a first arm slot and a second arm nib;

wherein the second arm nib is sized such that the second arm nib fits into the negative space formed by the first arm slot.

7. The beverage straw according to claim 6 wherein the second arm nib is a rectangular block structure that attaches to the exterior surface of the lateral face of the second arm.

8. The beverage straw according to claim 7 wherein the first arm slot guides the motion of the second arm nib as the position of the second arm within the first arm changes.

9. The beverage straw according to claim 8 wherein the first arm slot is a negative space that is formed in the interior surface of the lateral face of the first arm;

wherein the second arm nib is sized such that the second arm nib fits into the negative space formed by the first arm slot;

wherein the first arm slot forms a track that guides the motion of the second arm through the first arm.

10. The beverage straw according to claim 9 wherein the first arm slot further comprises a first anchor notch, a second anchor notch, and a groove;

wherein the groove is a negative space that is formed in the interior surface of the lateral face of the first arm;

wherein the first anchor notch is a negative space that is formed in the interior surface of the lateral face of the first arm;

wherein the second anchor notch is a negative space that is formed in the interior surface of the lateral face of the first arm.

11. The beverage straw according to claim 10 wherein the groove has a roughly prism-shaped structure;

wherein the center axis of the rough prism shape of the groove is parallel to the center axis of the first arm;

wherein the groove is sized to receive the second arm nib;

wherein the groove forms a track that guides the motion of the second arm nib as the second arm moves in the first arm in a direction parallel to the center axis of the first arm.

12. The beverage straw according to claim 11 wherein the negative space that forms the first anchor notch forms an extension of the negative space formed by the groove;

wherein the first anchor notch attaches to the lateral face of the negative space of the groove at a position proximal to a congruent end of the roughly prism-shaped structure of the groove;

wherein the first anchor notch is sized to receive the second arm nib;

wherein the negative space that forms the second anchor notch forms an extension of the negative space formed by the groove;

wherein the second anchor notch attaches to the lateral face of the negative space of the groove at a position proximal to the congruent end of the roughly prism-shaped structure of the groove that is distal from the first anchor notch;

wherein the second anchor notch is sized to receive the second arm nib.

13. The beverage straw according to claim 12 wherein the first anchor notch forms a track that guides the motion of the second arm nib as the second arm rotates within the first arm around an axis of rotation aligned with the center axis of the first arm;

wherein the first anchor notch locks the second arm into a fixed position relative to the first arm when the second arm nib rotates into the first anchor notch;

wherein the second anchor notch forms a track that guides the motion of the second arm nib as the second arm rotates within the first arm around an axis of rotation aligned with the center axis of the first arm;

wherein the second anchor notch locks the second arm into a fixed position relative to the first arm when the second arm nib rotates into the second anchor notch.

14. The beverage straw according to claim 13 wherein the plurality of caps comprises a first capped tube and a second capped tube;

wherein the first capped tube is a lid that encloses the open end of the second arm of the tubular transport structure that is distal from the first arm;

wherein the second capped tube is a lid that encloses the open end of the first arm of the tubular transport structure that is distal from the second arm.

15. The beverage straw according to claim 14 wherein the first capped tube is a prism structure;

wherein the first capped tube has a capped tube shape;

wherein the first capped tube is further defined with a third inner diameter;

wherein the span of the length of the third inner diameter of the first capped tube is greater than the span of the length of the second outer diameter of the second arm such that the first capped tube fits over and encloses the second arm during storage.

16. The beverage straw according to claim 15 wherein the second capped tube is a prism structure;

wherein the second capped tube has a capped tube shape;

wherein the second capped tube is further defined with a fourth inner diameter;

wherein the span of the length of the fourth inner diameter of the second capped tube is greater than the span of the length of the first outer diameter of the first arm such that the second capped tube fits over and encloses the first arm during storage.

17. The beverage straw according to claim 16 wherein the first capped tube further comprises a pocket clip;

wherein the pocket clip is a roughly prism-shaped structure;

wherein the pocket clip attaches to the exterior surface of the first capped tube such that the center axis of the pocket clip is parallel to the center axis of the first capped tube;

wherein the pocket clip attaches to the first capped tube in the manner of a cantilever;

wherein the pocket clip attaches to the first capped tube such that the free end of the cantilever structure of the pocket clip extends beyond the open end of the capped tube structure of the first capped tube;

wherein the pocket clip attaches the beverage straw to a sheeting such as the textile used to form a pocket in clothing.

* * * * *